US008280085B2

(12) United States Patent
Heerlein et al.

(10) Patent No.: US 8,280,085 B2
(45) Date of Patent: Oct. 2, 2012

(54) HEARING AID WITH LED AND METHOD OF OPERATION

(75) Inventors: Markus Heerlein, Singapore (SG); Harald Klemenz, Fürth (DE)

(73) Assignee: Siemens Medical Instruments Pte. Ltd., Singapore (SG)

( * ) Notice: Subject to any disclaimer, the term of this patent is extended or adjusted under 35 U.S.C. 154(b) by 216 days.

(21) Appl. No.: 12/856,802

(22) Filed: Aug. 16, 2010

(65) Prior Publication Data

US 2011/0038500 A1 Feb. 17, 2011

(30) Foreign Application Priority Data

Aug. 14, 2009 (DE) ..... 10 2009 037 606

(51) Int. Cl.
*H04R 25/00* (2006.01)

(52) U.S. Cl. ..... 381/312; 381/322; 381/323

(58) Field of Classification Search ..... 381/312, 381/322, 323
See application file for complete search history.

(56) References Cited

U.S. PATENT DOCUMENTS

| | | | | |
|---|---|---|---|---|
| 4,357,497 | A * | 11/1982 | Hochmair et al. | 607/5 |
| 6,704,424 | B2 * | 3/2004 | Killion | 381/323 |
| 7,394,911 | B2 * | 7/2008 | Joergensen et al. | 381/322 |
| 7,577,267 | B2 * | 8/2009 | Barthel et al. | 381/315 |
| 8,027,638 | B2 * | 9/2011 | Sanguino et al. | 455/41.2 |
| 2005/0008178 | A1 * | 1/2005 | Joergensen et al. | 381/322 |
| 2009/0129615 | A1 | 5/2009 | Kasanmascheff | |
| 2010/0142740 | A1 * | 6/2010 | Roerup | 381/330 |

FOREIGN PATENT DOCUMENTS

| | | | |
|---|---|---|---|
| DE | 102007055382 | A1 | 6/2009 |
| EP | 1727395 | A2 | 11/2006 |

* cited by examiner

*Primary Examiner* — Ramon Barrera
(74) *Attorney, Agent, or Firm* — Laurence A. Greenberg; Werner H. Stemer; Ralph E. Locher

(57) ABSTRACT

A hearing aid has a housing, a signal-processing arrangement housed in the housing, an LED, an actuatable switching element arranged on the housing, and a battery. The LED is connected to a positive pole of the battery with its anode connector and to a first connector of the signal-processing arrangement with its cathode connector. The signal-processing arrangement is formed with a monitoring unit, which switches the first connector if there is a drop below a first threshold voltage such that the cathode connector can be connected to a negative pole of the battery.

7 Claims, 1 Drawing Sheet

HEARING AID WITH LED AND METHOD OF OPERATION

CROSS-REFERENCE TO RELATED APPLICATION

This application claims the priority, under 35 U.S.C. §119, of German application DE 10 2009 037 606.2, filed Aug. 14, 2009; the prior application is herewith incorporated by reference in its entirety.

BACKGROUND OF THE INVENTION

Field of the Invention

The present invention relates to a hearing aid with a housing, a signal-processing arrangement housed in the housing, and an LED arranged on the housing and used to display a state of the signal-processing arrangement or an electronic component.

Hearing aids are portable hearing devices used to support the hard of hearing. In order to make concessions for the numerous individual requirements, different types of hearing aids are provided, e.g. behind-the-ear (BTE) hearing aids, hearing aids with an external receiver (receiver in the canal [RIC]) and in-the-ear (ITE) hearing aids, for example concha hearing aids or canal hearing aids (ITE, CIC) as well. The hearing aids listed in an exemplary fashion are worn on the concha or in the auditory canal. Furthermore, bone conduction hearing aids, implantable or vibrotactile hearing aids are also commercially available. In this case, the damaged sense of hearing is stimulated either mechanically or electrically.

In principle, the main components of hearing aids are an input transducer, an amplifier and an output transducer. In general, the input transducer is a sound receiver, e.g. a microphone, and/or an electromagnetic receiver, e.g. an induction coil. The output transducer is usually configured as an electroacoustic transducer, e.g. a miniaturized loudspeaker, or as an electromechanical transducer, e.g. a bone conduction receiver. The amplifier is usually integrated into a signal-processing arrangement.

These days, some hearing aids are equipped with an LED for a status display (e.g. hearing aid on/off, program number, battery status).

A disadvantage in the case of hearing aids with battery-status monitoring is that the user of the hearing aid is unsure when the LED is not illuminated as to whether the hearing aid is not operating because the battery has been discharged or because there may be another defect.

SUMMARY OF THE INVENTION

It is accordingly an object of the invention to provide a hearing aid with an LED and a method of operation which overcome the above-mentioned disadvantages of the prior art methods and devices of this general type, which allows a reliable statement to be made in respect of a too low battery status or a too low battery voltage.

In the case of a hearing aid with a housing, a signal-processing arrangement housed in the housing, an LED and an actuatable switching element arranged on the housing and a battery, the object is achieved by virtue of the fact that the LED is connected to a positive pole of the battery with its anode connector and to a first connector of the signal-processing arrangement with its cathode connector. The signal-processing arrangement is formed with a monitoring unit, which switches the first connector if a battery voltage drops below a first threshold voltage such that the cathode connector can be connected to a negative pole of the battery. By arranging the LED between a positive pole of the battery and the first connector, which is connected to the monitoring unit, it still is advantageously possible to illuminate the LED even though the monitoring unit, in its property as a "power management" unit, has already switched off the signal-processing arrangement due to the battery voltage being too low. The hearing aid can no longer operate without problems due to the low battery voltage, but the remaining battery voltage can be used for reliably stating that there no longer is sufficient battery voltage as a result of the provided switching of the light-emitting diode.

In an advantageous refinement, the switching element is connected to a fourth input of the signal-processing arrangement, and the monitoring unit is configured to recognize an actuation of the switching element in the case of a battery voltage below the first threshold voltage. This configuration of the hearing aid affords the possibility of recognizing a switch-on attempt in the case of insufficient battery capacity and of displaying this by the LED. This solves the known problem in hearing aids according to the prior art of the LEDs starting to illuminate at the time at which the battery voltage no longer suffices, provided these LEDs are available for displaying a low battery status. However, this procedure known from the prior art then allows the operating voltage of the battery to sink further during the entire illuminated period of the LED. It should be imagined that the user takes their hearing aid off overnight, wherein the battery of the hearing aid is already on the verge of reaching an insufficient voltage. If the LED status display would now start to illuminate shortly after the hearing aid has been taken off in order to signal a low battery status, the LED would illuminate for the entire period of time of non-use of the hearing aid and thus the battery would presumably finally be completely depleted and no more status signals could be retrieved from the hearing aid; however, by virtue of the fact that the LED in the hearing aid according to the invention only illuminates if a switch-on attempt was undertaken, the battery was spared to the extent that even next morning it still is possible to diagnose reliably that the battery is empty.

Furthermore, it is advantageous if the monitoring unit is formed with a timer for switching the first connector for a determinable period of time. By way of example, it would be possible to let the light-emitting diode light up for two seconds after a switch-on attempt in the case of a too low battery voltage and thereafter to switch the diode back to dark.

It is expedient for the monitoring unit to be configured to switch off the signal-processing arrangement in respect of the audio functionality if there is a drop below the first threshold voltage. In order to ensure a reliable audio functionality, which is provided by the signal-processing arrangement, it is more reliable to switch off the signal-processing arrangement completely below a certain voltage because signals can no longer be transmitted in an error-free fashion.

The object mentioned at the outset is likewise achieved by a method for operating the aforementioned hearing aid, wherein the signal-processing arrangement is switched off if there is a drop below the battery voltage required for reliable operation and if an attempt is made to switch it on via the switching element, the LED is connected to the battery by the monitoring unit such that the remaining battery voltage is used to illuminate the LED. Although this method in principle allows the LED to be illuminated permanently with the remaining battery voltage, this harbors the disadvantage of this permanent energy use discharging the battery to the extent that a reliable diagnosis of whether the battery is now empty or whether another fault of the hearing aid is present cannot be gathered from the hearing aid.

In order to continue to save valuable remaining energy of the battery, it is advantageous for the LED to be illuminated from a start time of the switch-on attempt for a determinable period of time via the first connector and to be switched to be inactive once the period of time has passed.

It is furthermore expedient for the LED to be actuated by a pulse train for signaling a battery replacement, wherein the pulse train corresponds to a servicing code. By way of example, this would thus also afford the possibility of signaling not only a servicing code for a battery replacement, but also outputting other faults using the LED by a certain pulse train similar to the Morse code alphabet.

Other features which are considered as characteristic for the invention are set forth in the appended claims.

Although the invention is illustrated and described herein as embodied in a hearing aid with an LED and a method of operation, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE INVENTION

Figure 1:
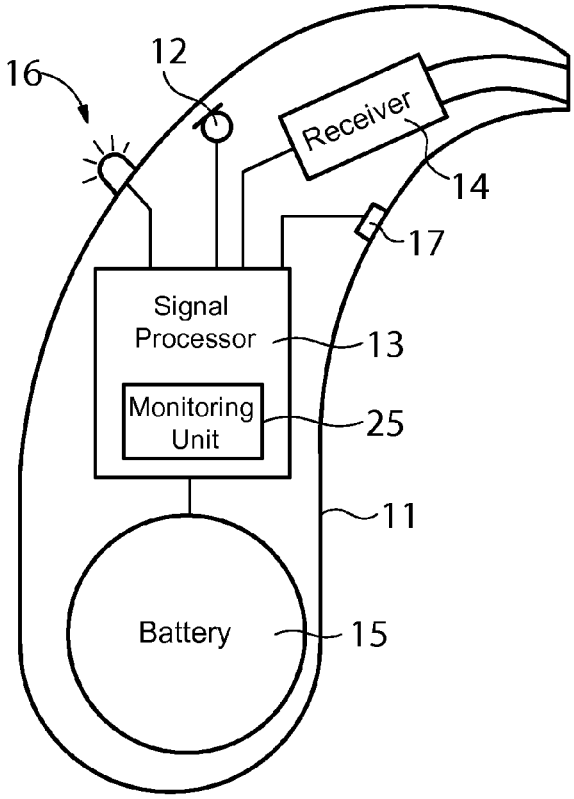
FIG. 1 is a schematic diagram of a hearing aid according to the invention.

Referring now to the figures of the drawing in detail and first, particularly, to FIG. 1 thereof, there is shown in an exemplary fashion a BTE hearing aid with a housing 11. The housing 11 conventionally contains one or more microphones 12, a signal-processing arrangement 13, a receiver 14 and a battery 15. An LED 16 connected to the signal-processing arrangement 13 is used for signaling a low battery voltage U.

The hearing aid can be switched on by a switching element 17, which is, for example, configured as a pushbutton. The switching element 17 is connected to the signal-processing arrangement 13, wherein the signal-processing arrangement 13 is formed to recognize a push on the switching element 17 and to switch on the hearing aid. In the switched-on state, the signal-processing arrangement is supplied by the battery 15 and sound is received by the microphone 12, transmitted to the signal-processing arrangement 13 and emitted in an amplified fashion by a receiver 14.

Figure 2:
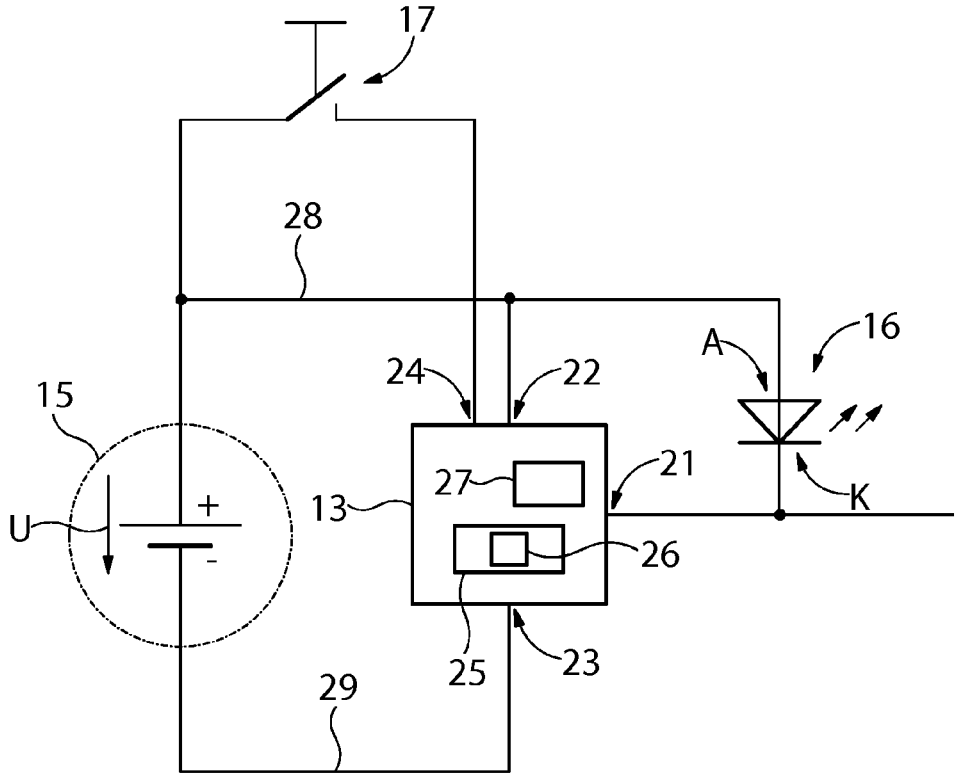
FIG. 2 is a block diagram of a circuit of a battery, a signal-processing arrangement and an LED.

According to FIG. 2, a circuit arrangement is sketched that allows the hearing aid to illuminate the LED despite the signal-processing arrangement 13 being switched off. Starting off with an initial battery voltage U with a value of 1.2 V, the signal-processing arrangement 13 is duly switched on after a switch-on attempt via the pushbutton 17 and the hearing aid commences operation with the battery voltage U of 1.2 V.

The signal-processing arrangement 13 is connected to the positive pole of the battery 15 via a first supply voltage line 28 and to the negative pole of the battery 15 via a second supply voltage line 29.

An anode side of the LED 16 is connected to the positive pole of the battery 15. A cathode connector of the LED 16 is connected to a first connector 21 of the signal-processing arrangement 13. As a result of this connection of the LED 16, the cathode side of the LED 16 can be connected to the negative pole of the battery 15. Here, a monitoring unit 25 is formed such that it, preferably formed with semiconductor technology, has switching means that, as a result of a corresponding circuit design of the signal-processing arrangement 13 or the monitoring unit 25, connects the first connector 21 to the second supply voltage line 29 such that current can flow from the positive pole of the battery 15 to the negative pole of the battery 15 via the light-emitting diode 16.

This switching function of the signal-processing arrangement 13 or of the monitoring unit 25, which switching function has for example been realized in a freely programmable circuit, should preferably be possible if the monitoring unit 25 detects that the battery voltage 15 has for example dropped below a value of 0.9 V.

The signal-processing arrangement 13 usually still operates without problems up to a value of 0.9 V and hence a reliable audio functionality is ensured. If the voltage drops below 0.9 V, a "power management functionality" implemented in the monitoring unit 25 is carried out. That is to say the signal-processing arrangement 13 is switched off in respect of its audio functionality and the current path for the current through the LED 16 is prepared at the same time in the monitoring unit. Here, a voltage of 0.9 V still suffices for driving current through the LED 16 and thereby illuminating the latter.

Here, the signal-processing arrangement 13, in turn a programmable integrated circuit, is formed to recognize a switch-on attempt via the pushbutton. During this switch-on attempt, the LED 16 is connected to the battery 15 by the monitoring unit 25 such that the remaining battery voltage U illuminates the LED 16.

For further conservation of remaining energy, the monitoring unit 25 has a timer 26, which illuminates the LED 16 via the first connector 21 for a determinable period of time from the start time of the switch-on attempt and switches the LED 16 to be inactive once the period of time has passed.

In order to illuminate the LED 16 even in the case of a low battery voltage U of 0.9 V or even less, the signal-processing arrangement 13 has an LED driver 27. The LED driver 27 is formed to provide sufficient current, preferably 20 μA, in order still to illuminate the light-emitting diode 16 even at this low battery voltage U.

In order to support the industrial applicability, reference is made to a voltage step-up component of the type PR 4401. The data sheet PR 4401 by Prema Semiconductor is herewith incorporated by reference herein.

The invention claimed is:

1. A hearing aid, comprising:

a housing;

a signal-processing configuration housed in said housing and having a connector;

an actuatable switching element disposed on said housing;

a battery having a positive pole and a negative pole;

an LED having an anode connector connected to said positive pole of said battery and a cathode connector connected to said connector of said signal-processing configuration; and said signal-processing configuration having a monitoring unit switching said connector if a battery voltage drops below a given threshold voltage such that said cathode connector can be connected to said negative pole of said battery.

2. The hearing aid according to claim 1, wherein:

said signal-processing configuration has an input; and said actuatable switching element is connected to said input of said signal-processing configuration, and said monitoring unit is configured to recognize an actuation of said actuatable switching element in a case of a battery voltage below the given threshold voltage.

3. The hearing aid according to claim 1, wherein said monitoring unit has a timer for switching said connector for a determinable period of time.

4. The hearing aid according to claim 1, wherein said monitoring unit switches off said signal-processing configuration in respect of an audio functionality if there is a drop in the battery voltage below the given threshold voltage.

5. A method for operating a hearing aid, the hearing aid including a housing, a signal-processing configuration housed in the housing and having a connector, an actuatable switching element disposed on the housing, a battery having a positive pole and a negative pole, an LED having an anode connector connected to the positive pole of the battery and a cathode connector connected to the connector of the signal-processing configuration, the signal-processing configuration having a monitoring unit switching the connector if a battery voltage drops below a given threshold voltage such that the cathode connector can be connected to the negative pole of the battery, which comprises the steps of:

switching off the signal-processing configuration if there is a drop below the battery voltage required for reliable operation; and if an attempt is made to switch the signal-processing configuration on via the actuatable switching element, connecting the LED to the battery by means of the monitoring unit such that a remaining battery voltage is used to illuminate the LED.

6. The method according to claim 5, which further comprises illuminating the LED from a start time of a switch-on attempt for a determinable period of time via the connector and switching the LED to be inactive once the determinable period of time has passed.

7. The method according to claim 5, which further comprises actuating the LED by a pulse train for signaling a battery replacement, wherein the pulse train corresponds to a servicing code.

* * * * *